United States Patent [19]

Ohtsuki et al.

[11] Patent Number: 4,557,545

[45] Date of Patent: Dec. 10, 1985

[54] SHIELDED ELECTRICAL CONNECTOR

[75] Inventors: Tomonari Ohtsuki; Takao Hirose, both of Tochigi, Japan

[73] Assignee: Allied Corporation, Morris Township, Morris County, N.J.

[21] Appl. No.: 598,932

[22] Filed: Apr. 11, 1984

[30] Foreign Application Priority Data

Apr. 25, 1983 [JP] Japan ..... 58-61666[U]

[51] Int. Cl.[4] ..... H01R 13/58; H01R 13/658

[52] U.S. Cl. ..... 339/103 M; 339/143 R; 339/218 M; 174/35 C

[58] Field of Search ..... 339/136 R, 136 M, 138, 339/139 R, 139 C, 141, 143 R, 103 M, 218 M, 276 R, 276 A; 174/35 C, 78, 84 C

[56] References Cited

U.S. PATENT DOCUMENTS

| | | | |
|---|---|---|---|
| 2,852,423 | 9/1958 | Bassett, Jr. | 339/143 R |
| 3,744,128 | 7/1973 | Fisher et al. | 339/143 R X |
| 3,904,265 | 9/1975 | Hollyday et al. | 339/103 M |
| 4,337,989 | 7/1982 | Asick et al. | 174/35 C X |
| 4,453,798 | 6/1984 | Asick et al. | 339/143 R |
| 4,457,575 | 7/1984 | Davis et al. | 339/176 MP X |
| 4,497,533 | 2/1985 | Genova et al. | 339/143 R |

*Primary Examiner*—Joseph H. McGlynn
*Assistant Examiner*—Steven C. Bishop
*Attorney, Agent, or Firm*—Anibal Jose Cortina; Roger H. Criss

[57] ABSTRACT

A shielded electrical connector in which the shield cover is formed as two U-shaped parts, each of which includes an integral clamping portion for clamping with a shielded connector. The clamping portions are connected to the cover parts by leg portions. An insulator containing electrical contacts is sandwiched between the cover parts after the cable is attached to the contacts. The cover parts are compressed together, following which the clamp portions are clamped about the cable to provide electrical connection between the cable and the shield cover.

18 Claims, 14 Drawing Figures

FIG. 3a
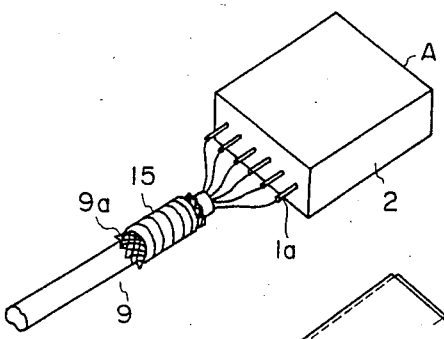
FIG. 3b
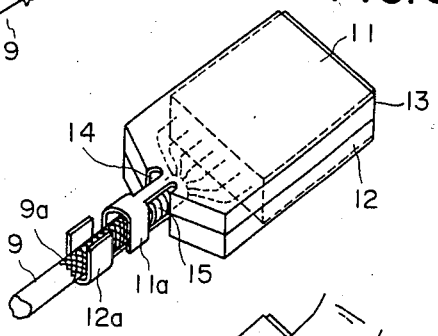
FIG. 4
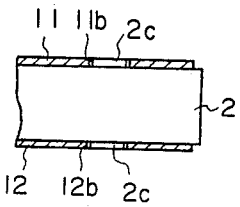
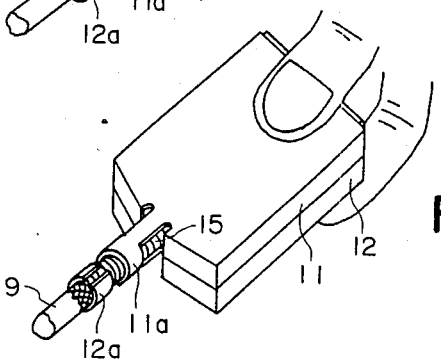
FIG. 3c

FIG.5
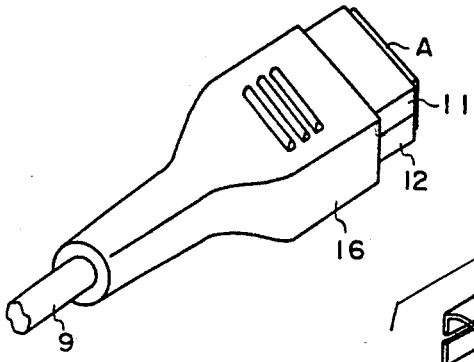
FIG.6a
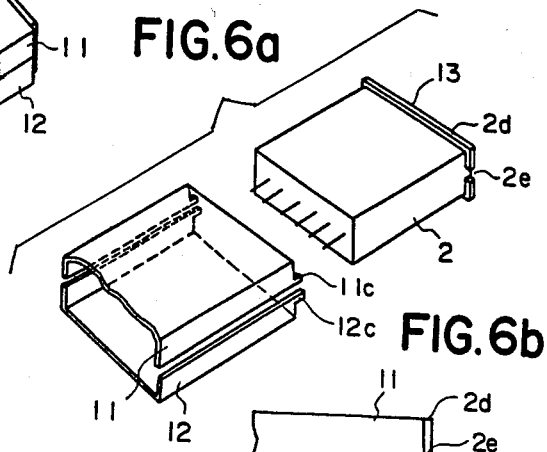
FIG.6b
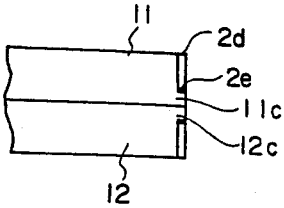
FIG.7
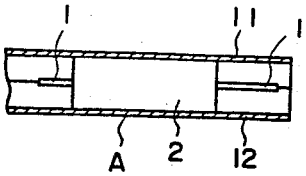
FIG.8
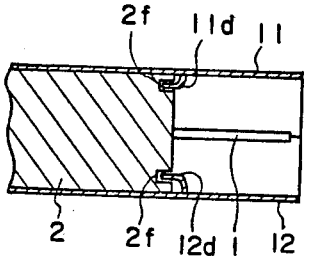
FIG.9a
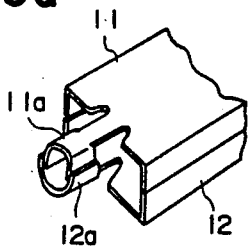
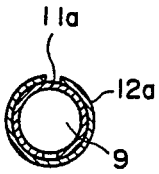
FIG.9b

SHIELDED ELECTRICAL CONNECTOR

BACKGROUND OF THE INVENTION

1. Field of the Invention

This invention relates to shielded electrical connectors.

2. Description of the Prior Art

In the mutual connection between high frequency machines, it becomes necessary to eliminate the effect of an external noise in the connecting cable, etc. Generally, therefore, a shielded cable is employed as a connecting cable and, at the same time, the plug connector which is used for connection is provided with an electroconductive cover, where the external jacket of the shield for the cable is connected.

At the time when this connector has been inserted into the receptacle of a high frequency machine, along with the mutual connection among the contacts, the cover of the plug connector is electrically connected with an electroconductive cover of the receptacle, with a result that the outer cover of the shield may be grounded through the housing of the high frequency machine in the receptacle.

In the case of the conventional connector, however, the number of parts involved is relatively large, with a consequence that it is troublesome and relatively expensive to manufacture. In addition, the connecting operation becomes complicated and, moreover, the shielding effect is insufficient.

A prior art connector is shown in FIG. 1, and includes a connector A having an insulator 2 supporting contacts 1 having connection terminal elements 1*a*. Connector A is provided with electrically conductive covers 3 and 4 which may have flanges 3*a* and 4*a* that are integrally joined respectively in the screw insertion holes 3*b*, 4*b* (only holes 4*b* are visible). A flat and generally tubular shield cover B is used which has a cable withdrawal hole 5*a* at one end and with screw receptacles 5*b* at the other end. Shield cover B has an opening 5*d* surrounded by a flange 5*c*. A cable clamp C comprising first and second metal members 7 and 8 and a tightening screw 6 is fixed to cover B adjacent cable withdrawal hole 5*a* thereof by such means as soldering.

Accordingly, the total number of component parts of the prior design reaches as many as nine, with a result that the structure involved becomes complicated and that the price also rises accordingly.

In regard to the connection of the cables, moreover, one end of the cable 9 is inserted into the shield cover B through the metal clamp C and the cable withdrawal hole 5*a* and is pulled out of the opening 5*d*, followed by the connection of the base wires with the connection terminal elements 1*a* of the connector A.

Thereafter, the connector A is fixed to the opening part 5*d* of the shield cover B by means of a female screw hole 5*b* and installation screws 10 extending into receptacles 5*b* and the cable 9 which has been passed into the metal clamp C is finally tightened by tightening screws 6. After assembly, the shield outer cover 9*a* of the cable will have to be electrically connected with the shield cover B and, at the same time, it will have to be mechanically fixed.

Accordingly, the prior art construction is not only complicated but the connecting operation is also troublesome. Since the shield cover B is tubular, moreover, should it be forgotten to install shield cover B over the cable 9, it becomes necessary to release the connection between the connector and the cable which have already been connected, install the shield cover and again connect the connector.

Moreover, the metal clamp C is made so as to be able to clamp against cables having diameters which are within a certain range. The cable withdrawal hole 5*a* is also chosen in accordance with the same principle. As a result, if the diameter of the cable is small as compared with the size of the hole, tightening becomes dissatisfactory and, accordingly, there develops a possibility of grounding becoming dissatisfactory. Moreover, a leakage of electric waves takes place from the gap between the cable withdrawal hole 5*a* of the shield cover B and the cable 9. Because of this, there is a shortcoming in that the shielding effect becomes dissatisfactory.

It would be desirable to provide a connector which is small in size and low cost, which has a shielding effect and which eliminates various kinds of shortcomings experienced in a conventional connector as has been described above.

SUMMARY OF THE INVENTION

In accordance with this invention, there is provided in a shielded electrical connector including at least one electrical contact supported by a supporting insulator, a shield cover for the connector and a cable clamp for engaging a cable adapted to be connected with the connector, the improvement comprising:

the shield cover being formed of separate top and bottom overlapping parts adapted to be compressed to each other so as to sandwich the insulator therebetween, and cable clamp means integrally formed with each of the top and bottom parts and adapted to engage with the cable after the top and bottom parts are overlapped on the insulator, so that the cable is electrically connected to the shield cover.

Preferably, the cable clamp means are in the form of compressible U-shaped portions connected by leg portions to the top and bottom parts of the shield cover. Also, the rear portion of each of the top and bottom parts are provided with openings which form a cable receiving entryway. Positioning means and retention means are preferably also provided.

The connector of this invention has a reduced number of parts, can be small in size, can be easily manufactured and is readily connected to a shielded cable.

BRIEF DESCRIPTION OF THE DRAWINGS

FIGS. 3*a*, 3*b* and 3*c* show the assembly of the connector of FIG. 2 to a cable.

FIG. 4 is an enlarged partial cross-section view of the connector retained within the shield cover by retention means.

FIG. 5 is a perspective view of the connector having a molded cover.

FIG. 6*a* is a perspective view of the connector which includes means to maintain the opening at the front of the connector in an open position.

FIG. 6*b* is an enlarged partial cross-section view of the front of the insulator shown in FIG. 6*a*.

FIG. 7 is an enlarged partial cross-section view of a male connector.

FIG. 8 is an enlarged partial cross-section view showing the retention of the insulator in the cover shield.

FIG. 9*a* is a perspective view of an alternate embodiment of the cable clamp of the connector.

FIG. 9*b* is a cross-section view of the cable clamp of FIG. 9*a*.

DESCRIPTION OF THE PREFERRED EMBODIMENTS

Figure 1A:
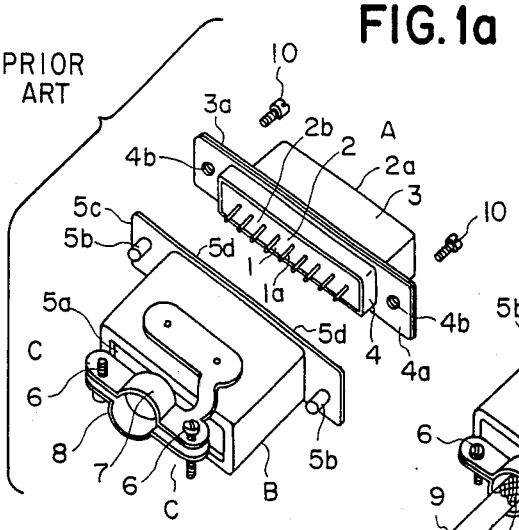
FIG. 1*a* is a perspective view of a prior art connector before assembly.
Figure 1B:
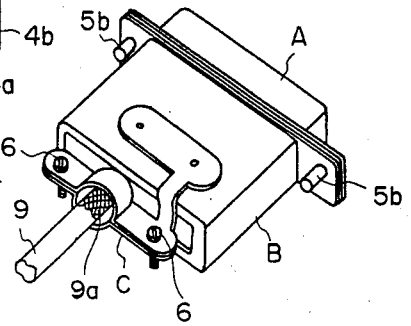
FIG. 1*b* is a perspective view of the connector of FIG. 1*a* after assembly.
Figure 2:
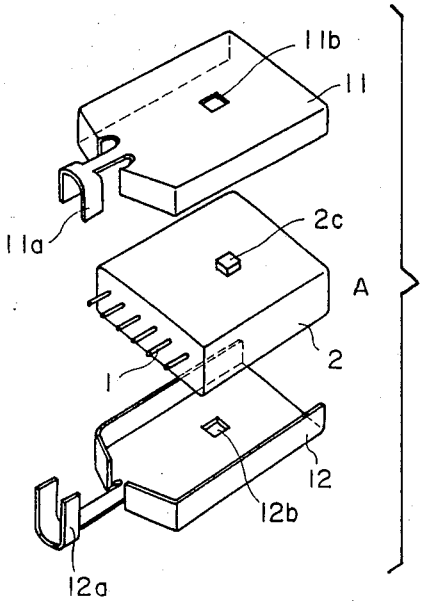
FIG. 2 is an exploded perspective view of the connector of this invention before connection to a cable.

With reference to FIG. 2, in accordance with this invention connector A (shown as a female connector) comprises contacts 1 supported in an insulator 2. The shield cover is in the form of first and second shield cover forming parts 11 and 12. The forward end of shield cover forming parts 11, 12 forms an opening for the insertion of another connector, and the rear end of parts 11, 12 has an opening 14 for withdrawal of cable 9, as shown in FIG. 3*b*. Parts 11, 12 are shaped so as to overlap each other to form a U-shaped cross-section dimensioned to envelop connector A without any gap. At the rear of each part 11, 12, a generally U-shaped clamping portion 11*a*, 12*a* is formed, which portions are integrally connected with parts 11, 12 by connecting legs. The connecting leg connecting clamping portion 12*a* to part 12 is longer than the leg connecting clamping portion 11*a* to part 11, such that when assembled with a cable 9 (FIG. 3*b*), each clamping portion 11*a*, 12*a* separately clamps against cable 9 and are spaced from each other. Clamping portions 11*a* and 12*a* are formed of compressive metal for ease in clamping cable 9.

As shown in FIG. 3*a*, for the connection of cable 9 to insulator 2, first the cable cover is stripped back to expose shield external jacket 9*a*, which is folded back on the cable. The individual conductors are then joined by soldering or other means to contacts 1. Preferably, an aluminum tape 15 is wound about the end of cable 9, which tape is electroconductive with cable 9, in order to increase the diameter of the cable at its terminating end with respect to cable withdrawal hole 14. This prevents any gap between cable 9 and cable withdrawal hole 14, so that it is possible to obtain a satisfactory shielding effect. In the next step, shield cover forming parts 11, 12 are sandwiched about insulator 2, and compressed together. Clamping portions 11*a*, 12*a* are compressed against cable shield jacket 9*a*, with a suitable compressive metal tool, such that the cable is connected to the shield cover. Shield cover forming parts are also compressively joined with each other.

Since the number of constituent parts required in this connector is less than one half of the conventional connector, the manufacturing steps become simple accordingly and the size of the product can be reduced accordingly. Moreover, costs are reduced and the connecting operation is simplified. Since there is no need to pass the cable through the shield cover as in the conventional method and there is no danger of connecting the cable with the connector at all, there will be no requirement of going through the trouble of reconnection as a result of the same.

According to this invention, therefore, it becomes possible to supply small-sized and low-priced connectors whose production is easy and whose connecting operation is simple, which has eliminated the shortcomings of the conventional connectors and which is equipped with the shield function.

When the number of electrodes in a connector becomes large, the contact pressure between the contacts themselves of the opposite connectors which have been fixed to the panel becomes large. Because of this, in the case where the maintenance of the connector A due to the shield covers 11 and 12 becomes insufficient, the connector A is pushed in a direction which is opposite to the direction of insertion due to the force of opposition based on the contact pressure between the contacts themselves at the time when it is inserted into the opposite receptacle connector which has been fixed to the panel, etc., with a result that shield covers 11 and 12 move forward ahead of the connector A and there is a danger that the connecting terminal element of the contact that has been exposed may contact the inner surface of the shield cover.

To avoid such problem, in one embodiment of this invention there is provided a position regulating protrusion 2*c* on the upper and lower surfaces of the holding insulator 2 of the connector A as shown in FIG. 2 (only the upper protrusion being visible), and drop-in holes 11*b* and 12*b* are provided for the positional regulating protrusions 2*c* at the corresponding parts of the shield cover forming parts 11 and 12 respectively. The assembled position is shown in FIG. 4, with protrusions 2*c* being retained within holes 11*b*, 12*b*. As a result, the position of connector A within the shield cover is fixed from longitudinal movement.

It is also possible to mold a plastic housing around the assembly from a synthetic resin 16, as shown in FIG. 5, thereby increasing the holding force of the connector A. In the case where the number of electrodes has increased and the size of the connectors becomes large, furthermore, there is a corresponding increase in the thickness of the sheet of the shield covers 11 and 12 and, accordingly, the thickness of the compressive metal clamps 11*a* and 12*a* which have been formed by extrusion integrally with the same also increases.

Accordingly, a large force will be required for compressive adhesion, with a result that it becomes increasingly difficult to continue manual clamping in such a manner that the opening for the insertion of the opposite receptacle connector may not be fully open. To avoid this, a shown in FIGS. 6*a* and *b*, a support protrusion 2*d* is formed on part 2 and, at the same time, a support recess 2*e* is provided in the direction of the thickness of the support protrusion on the side surface.

Moreover, as shown in FIGS. 6*a* and *b*, support protuberant pieces 11*c* and 12*c* which can enter the aforementioned support recess 2*e* are provided at both side terminals of the shield cover forming parts 11, 12 on the side of the opening for the insertion of the opposite connectors, so that the shield cover forming parts 11 and 12 may not open at the time of the compressive adhesion of the compressive metal clamps 11*a* and 12*a*.

Since, in such a case, the support protrusion 2*d* which has been provided on the holding insulator 2 of the connector at the time of the insertion into the opposite connector abuts against the tip of the shield cover forming parts 11 and 12, there is an effect of preventing the shield covers 11 and 12 moving forward of the connector A at the time of the insertion into the opposite connector.

It is mentioned in this connection that the support protrusion 2*d* on the side of the holding insulator 2 may be provided for such a length as is necessary for forming the support recess part 2*e*. Moreover, even though an explanation has been given above by using the female connector as an example, it is only necessary in the case of a male connector to effect covering by the shield cover forming parts 11 and 12 in such a manner as to cover the side surface of the protuberant male contact 1 as shown in FIG. 7.

In connection with the retention of the holding insulator 2 to the shield cover forming parts 11 and 12, moreover, it is only necessary to provide a support recess 2*f* above and below the terminal face of the holding insulator 2 as shown in FIG. 8, for instance, and provide L-shaped support arms 11*d* and 12*d* that enter the support recesses 2*f* on the side of the shield cover forming parts 11 and 12.

In the above embodiment, compressively adhered metal clamps 11*a* and 12*a* are provided at different positions at one terminal of the shield cover forming parts 11 and 12, thereby compressing the cable 9. However, it is also possible to compressively adhere the compressive metal clamps 11*a* and 12*a* at the same locations as shown in FIGS. 9*a* and 9*b*.

As is clear from the above explanation, this invention provides a small-sized and low-cost connector equipped with a sufficient shielding function, whose production is easy to achieve and in which the connections are easy to carry out.

We claim:

1. In a shielded electrical connector including at least one electrical contact supported by a supporting insulator, a shield cover for the connector and a cable clamp for engaging a cable adapted to be connected with the connector, the improvement comprising:

said shield cover being formed of separate top and bottom overlapping parts adapted to be compressed to each other so as to sandwich said insulator therebetween, and cable clamp means integrally formed with each of said top and bottom parts and adapted for engaging with said cable, after said top and bottom parts are overlapped on said insulator, and for electrically connecting said cable to said shield cover, whereby the requirement of clamping means, separate from the connector, to ensure secure mechanical and electrical connection between the connector and the cable is eliminated.

2. The connector of claim 1 wherein said cable clamp means are in the form of compressible U-shaped portions connected by leg portions to said top and bottom parts of said shield cover.

3. The connector of claim 1 in which said top and bottom parts have front and rear portions, said clamp means being located adjacent said rear portions of said top and bottom parts, and said top and bottom parts also each being provided with an opening adjacent its rear portion, said openings forming a cable receiving entryway for said cable when said first and second parts are compressed together.

4. The connector of claim 3 wherein said top and bottom parts have generally U-shaped cross-sections.

5. The connector of claim 4 including positioning means to position said insulator with respect to said top and bottom shield cover parts.

6. The connector of claim 5 wherein said positioning means comprises at least one protrusion located on each of the upper and lower faces of said insulator, and corresponding apertures located on each of said top and bottom parts, said protrusions entering into said apertures when said parts are assembled together.

7. The connector of claim 4 including front and rear portions of said insulator, said electrical contact being located at the rear portion of said insulator and the front portion of said insulator adapted to be engaged with another complementary connector, and a support protrusion provided on said front portion of said insulator.

8. The connector of claim 7 including recesses on said support protrusion, and forwardly extending protuberances provided on said forward portions of said top and bottom parts, said protuberances adapted to be received within said recesses.

9. The connector of claim 4 including a plastic housing molded about said shield cover and said cable.

10. The connector of claim 4 including retention means for assisting in retaining said insulator within said top and bottom shield cover parts.

11. The connector of claim 10 wherein said retention means comprises support recesses in said insulator and support arms on said top and bottom parts, said support arms being adapted to be received within said support recesses.

12. A shielded electrical connector as in claim 1 for use with a cable adapted for being connected with the connector, in combination with electroconductive tape means for being wound around said cable near the end of said cable to be connected to the connector for increasing the diameter of the cable to ensure a tight electrical connection with the connector whereby a satisfactory shielding effect is obtained.

13. In a shielded electrical connector including at least one electrical contact supported by a supporting insulator, a shield cover for the connector and a cable for engaging a cable adapted to be connected with the connector, the improvement comprising:

said shield cover being formed of separate top and bottom overlapping parts adapted to be compressed to each other so as to sandwich said insulator therebetween, said top and bottom parts being of generally U-shaped cross sections and each being provided with an opening adjacent its rear portion to thereby define a cable receiving entry way for said cable when said first and second parts are compressed together, and cable clamp means integrally formed with each of said top and bottom parts and adapted for engaging with said cable, after said top and bottom parts are overlapped on said insulator, and for electrically connecting said cable to said shield cover, said cable clamp means being in the form of compressible U-shaped portions connected by leg-portions to said top and bottom parts of said shield cover adjacent said rear portion of said top and bottom parts, and one of said leg portions connecting one of said U-shaped clamp portions to one of said top and bottom parts being longer than the other of said leg portions, whereby said cable is clamped at two locations when said U-shaped clamp portions are compressed about said cable.

14. The connector of claim 13 including positioning means to position said insulator with respect to said top and bottom shield cover parts.

15. A shielded electrical connector as in claim 13 for use with a cable adapted for being connected with the connector; in combination with electroconductive tape means for being wound around said cable near the end of said cable to be connected to the connector for increasing the diameter of the cable to ensure a tight electrical connection with the connector at said opening whereby a satisfactory shielding effect is obtained.

16. In a shielded electrical connector including at least one electrical contact supported by a supporting insulator, a shield cover for the connector and a cable clamp for engaging a cable adapted to be connected with the connector, the improvement comprising:

said shield cover being formed of separate top and bottom overlapping parts adapted to be compressed to each other so as to sandwich said insulator therebetween, said top and bottom parts being of generally U-shaped cross section and each being provided with an opening adjacent its rear portion to thereby define a cable receiving entry way for said cable when said first and second parts are compressed together, and cable clamp means integrally formed with each of said top and bottom parts and adapted for engaging with said cable, after said top and bottom parts are overlapped on said insulator, and for electrically connecting said cable to said shield cover, said cable clamp means being in the form of compressible U-shaped portions connected by leg-portions to said top and bottom parts of said shield cover adjacent said rear portion of said top and bottom parts, said leg portions to said top and bottom parts being approximately the same length, and one of said U-shaped clamp portions being adapted for being at least partially surrounded by the other of said clamp portions when said clamp portions are compressed against said cable, whereby said cable is clamped at a single location.

17. The connector of claim 16 including positioning means to position said insulator with respect to said top and bottom shield cover parts.

18. A shielded electrical connector as in claim 16 for use with a cable adapted for being connected with the connector, in combination with electroconductive tape means for being wound around said cable near the end of said cable to be connected to the connector for increasing the diameter of the cable to ensure a tight electrical connection with the connector at said opening whereby a satisfactory shielding effect is obtain.

* * * * *